US007362991B2

(12) United States Patent
Tanaka

(10) Patent No.: US 7,362,991 B2
(45) Date of Patent: Apr. 22, 2008

(54) IMAGE FORMING APPARATUS

(75) Inventor: Shigeru Tanaka, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 309 days.

(21) Appl. No.: 11/335,598

(22) Filed: Jan. 20, 2006

(65) Prior Publication Data

US 2006/0177243 A1 Aug. 10, 2006

(30) Foreign Application Priority Data

Feb. 4, 2005 (JP) ..... 2005-029875

(51) Int. Cl.
*G03G 15/09* (2006.01)

(52) U.S. Cl. ..... 399/267; 399/270

(58) Field of Classification Search ..... 399/116, 399/252, 265, 266, 267, 270, 279, 281, 282
See application file for complete search history.

(56) References Cited

U.S. PATENT DOCUMENTS 5,671,467 A * 9/1997 Katsumata et al. ..... 399/164
5,960,239 A * 9/1999 Toyoshima et al. ..... 399/284
6,449,442 B1 9/2002 Shida et al. ..... 399/63
RE38,026 E * 3/2003 Tada et al. ..... 399/275
7,224,924 B2 * 5/2007 Okamoto ..... 399/119
2006/0008300 A1 1/2006 Tanaka ..... 399/269

FOREIGN PATENT DOCUMENTS

JP 11-7189 1/1999

* cited by examiner

*Primary Examiner*—Hoan Tran
(74) *Attorney, Agent, or Firm*—Fitzpatrick, Cella, Harper & Scinto

(57) ABSTRACT

An image forming apparatus having a photosensitive drum bearing an electrostatic image, and a developing sleeve carrying a developer for developing the electrostatic image, the developing sleeve is in non-contact with the photosensitive drum, and is designed to be flexed so that the surface of the developing sleeve may go away from the surface of the photosensitive drum, and the rotation axis of the photosensitive drum and a straight line linking the centers of the cross-sections of the developing sleeve in a direction perpendicular to the developing sleeve at the both end portions may be in the skew relationship so that the value of the difference between the closest distance at the central portion of a maximum electrostatic image forming width and the closest distance at the both end portions thereof may be smaller than the value of the component of the flexure amount of the developing sleeve in the direction of the closest distance.

7 Claims, 6 Drawing Sheets

IMAGE FORMING APPARATUS

BACKGROUND OF THE INVENTION

1. Field of the Invention

This invention relates to an image forming apparatus using an electrophotographic printing method or an electrostatic recording method such as a copying machine, a printer or a facsimile apparatus.

2. Related Background Art

In conventional image forming apparatuses using an electrophotographic printing method, and above all, an image forming apparatus which effects color image formation, there is widely utilized a two-component developing method using a mixture of a nonmagnetic toner (toner) and a magnetic carrier (carrier) as a developer. The two-component developing method, as compared with other developing methods proposed at present, has such merits as the stability of the quality of image and the durability of the apparatus.

As an example of a conventional popular developing apparatus adopting the two-component developing method, mention may be made, for example, of one described in Japanese Patent Application Laid-open No. H11-007189. A two-component developing apparatus will now be described with reference to FIG. 6 of the accompanying drawings.

In such a two-component developing apparatus 1 as described in Japanese Patent Application Laid-open No. H11-007189, a developing sleeve 9 which is a developer carrying member has the function of holding a two-component developer 3 on the surface thereof by a magnetic force, and carrying it to a developing region 25 opposed to a drum-shaped electrophotographic photosensitive member (hereinafter referred to as the "photosensitive drum") 100 as an image bearing member, and is disposed with a predetermined clearance with respect to the surface of the photosensitive drum, and has the function of applying a predetermined developing electric field to the clearance to thereby cause the toner to adhere to an electrostatic image.

As the radius of the developing sleeve 9, the order of 8 to 12 mm has heretofore been the mainstream, but in recent years, developing sleeves having a radius of about 6 mm have also been produced.

Also, as the material of the developing sleeve 9, as described in Japanese Patent Application Laid-open No. H11-007189, use is made of a nonmagnetic material such as aluminum or nonmagnetic stainless steel, but in recent years, aluminum has become the mainstream with the tendency toward a lower price.

On the other hand, due to a rise in the needs for color images in recent years, in image forming apparatuses for effecting color image formation as well as monochromatic image forming apparatuses, the downsizing of the apparatus has come to be demanded with a lower cost of the apparatus. Particularly, as regards a developing apparatus, developing apparatuses for four colors are usually provided in an image forming apparatus which effects color image formation and therefore, the necessity of the downsizing thereof is high. Of course, the developing sleeve has been in the tendency toward downsizing and a smaller radius.

The developing sleeve 9, however, tends to become lower in its mechanical strength with the tendency toward a smaller radius. The reason for this is, first, that the radius simply becomes smaller. The next reason is that in order to keep the magnetic force of a magnet roller 7 contained in the developing sleeve at a desired level, the radius of the magnet roller 7 also cannot help assuming a size larger than a certain degree of size and therefore, the inner diameter of the developing sleeve 9 cannot be made small and accordingly, the thickness of the developing sleeve must avoidably be made small.

Now, the inventor has found the presence of the following new problem in the process of his development of a compact developing apparatus.

It is the phenomenon that the developing sleeve is made to carry thereon a two-component developer having magnetism, whereby the developing sleeve is elastically deformed.

The inventor has carried out the following measurement by the use of a developing apparatus of such a construction as described in Japanese Patent Application Laid-open No. H11-007189.

First, the shape of a developing sleeve in the developing apparatus has been measured in a state before a two-component developer supplied into the developing apparatus. The measuring apparatus used is a CNC three-dimensional measuring machine Crysta-Apex 1220 produced by Mitsutoyo Corporation.

In FIG. 6, the photosensitive drum 100 was detached, and three or more positions on the circumference of the developing sleeve 9 on the side thereof opposed to the photosensitive drum were measured. From the result of this measurement, the central position of a circle in the cross section of the developing sleeve 9 shown in FIG. 6 is calculated. This measurement is carried out over several locations in a direction perpendicular to the plane of the drawing sheet of FIG. 6 (the rotation axial direction of the developing sleeve 9 in such a manner as to include the end portions and center of the image forming width region of the image forming apparatus.

Next, the shape of the developing sleeve 9 in a state in which the developing sleeve 9 is coated with the two-component developer is measured.

First, the two-component developer is supplied into the developing apparatus, and the developing apparatus is driven as it is usually used, thereby bringing about a steady state in which the developing sleeve 9 has been coated with a predetermined amount of two-component developer. The driving of the developing apparatus is once stopped for the purpose of measurement, and the two-component developer on a portion of the developing sleeve 9 on the side thereof opposed to the photosensitive drum 100 of which the position is desired to be measured is partly removed. The size of the tip end of a probe used for the measurement is a size of the order of several millimeters and therefore, the range to be removed can be an area of the order of 10 mm square so that this probe can contact with the developing sleeve 9 without contacting with the two-component developer. The method of removing may be by quietly moving the two-component developer from the measuring portion by the use of a piece of paper, an applicator or the like, or may be suction or a blast by air, or attraction by a magnet. The toner directly adhering to the developing sleeve 9 can be removed by an air blast.

By such a method, the shape of the developing sleeve 9 with the two-component developer adhering thereto can be measured. However, if the two-component developer is removed too much, there is the possibility of causing the occurrence of a condition differing from a state originally desired to be measured and therefore, care must be taken.

When the inventor measured a change in the shape of the developing sleeve 9 due to the presence or absence of the two-component developer adhering thereto, in the manner as described above, it has been found that the central axis of a cylinder formed by the developing sleeve 9 is flexed in the form of a bow.

When the inventor then measured this difference under several conditions, the amount of deformation was generally a magnitude of the order of 0.010 mm to 0.200 mm in terms of the difference between the amounts of displacement of the circles at the both ends and center of the image forming width (hereinafter referred to as the "flexure amount δ").

The force producing this deformation is a force with which a magnet roller 7 magnetically attracts the two-component developer which is a magnetic material.

That is, the two-component developer having received the force with which it is attracted by the magnet roller 7 pushes the blank tube of the developing sleeve 9 and the circumferential distribution thereof is not uniform but is biased and therefore, by the resultant force thereof, the developing sleeve 9 is displaced in one direction.

Also, this force is axially uniformly applied in the region coated with the two-component developer and therefore, the developing sleeve 9 supported at its both ends is flexed in the form of a bow.

The flexure amount δ is changed in its magnitude and the direction of flexure by various conditions such as the material, shape and thickness of the blank tube of the sleeve, as well as the polar disposition and size of the magnet, the amount of magnetization of the magnetic carrier, and the amount of adhesion of the two-component developer attributable to the position of a regulating blade and the shape of a developer container.

As an example, the specific flexure amount δ under the conditions under which the inventor measured was as follows:

Aluminum blank tube radius 8 mm thickness 0.6 mm→δ=0.080 mm

Aluminum blank tube radius 8 mm thickness 0.8 mm→δ=0.055 mm

Stainless blank tube radius 8 mm thickness 0.5 mm→δ=0.020 mm

Here, the closest distance (hereinafter referred to as the "SD distance") between the photosensitive drum 100 and the developing sleeve 9 will be considered.

As is well known to those skilled in the art, the SD distance is an important design parameter in the two-component developing method, and generally, it is often the case that the SD distance is set to a range of the order of 0.200 mm to 1.000 mm.

The more uniform is this SD distance, the better is secured the uniformity of image density. According to the result of the inventor's research and experiment, when an amount of fluctuation exceeds 10% relative to the center design value of the SD distance, the uniformity of image density becomes unallowable. Particularly, in a case where due to the unevenness of mass production, the SD distance is biased to the maximum value side of the tolerance, or a case where the layer thickness of the two-component developer on the developing sleeve 9 is biased to the minimum value of the tolerance, such non-uniformity of the SD distance is liable to be actualized as the non-uniformity of image density.

The degree to which the flexure of the developing sleeve 9 affects the SD distance depends also on the relation between the direction of flexure of the developing sleeve 9 and the direction of the central position of the photosensitive drum 100 as it is viewed from the developing sleeve 9.

For example, when in FIG. 6, the direction of flexure of the developing sleeve 9 is a leftwardly upward direction of 45 degrees and the photosensitive drum 100 is in a just rightward direction as viewed from the developing sleeve 9, the SD distance is changed by an amount corresponding to 0.7 δ of the SD distance direction component of the flexure amount δ of the developing sleeve 9.

That is, although depending on the construction of the developing apparatus 1 and the disposition relation thereof with the photosensitive drum 100, there is a case where due to the smaller radius of the developing sleeve 9, the SD direction component of the flexure amount δ thereof exceeds 10%, and it has been found that this is one of factors which have spoiled the uniformity of image density.

SUMMARY OF THE INVENTION

So, it is the object of the present invention to provide an image forming apparatus which can achieve the uniformity of image density even if a developer carrying member is flexed.

An image forming apparatus for achieving the above object has:

an image bearing member bearing an electrostatic image thereon; the image bearing member having a circular arc configuration in a developing region;

a developer carrying member for carrying thereon a developer and carrying the developer to the developing region for developing the electrostatic image, the developer carrying member being rotatably supported and disposed at developer carrying member supporting positions in areas outside the both end portions of an area opposed to a maximum electrostatic image forming width in a rotation axial direction of the image bearing member so as to be in non-contact with the image bearing member in the developing region, and the developer carrying member being designed to be flexed by a force acting in an operative state so that in an area inside the developer carrying member supporting positions, the surface of the developer carrying member may go away from the surface of the image bearing member, wherein the image bearing member and the developer carrying member are disposed so that the rotation axis of the image bearing member and a straight line passing through the centers of the cross-sectional shapes of the developer carrying member in a direction perpendicular to the rotation axial direction of the developer carrying member at the both end portions thereof may be in the skew relationship so that in the operative state, the value of the difference between the closest distance between the image bearing member and the developer carrying member at the central portion of the maximum electrostatic image forming width and the closest distance between the image bearing member and the developer carrying member at the both end portions thereof may become smaller than the value of the component of the flexure amount of the developer carrying member in the area opposed to the maximum electrostatic image forming width, in the direction of the closest distance.

DESCRIPTION OF THE PREFERRED EMBODIMENTS

An image forming apparatus according to the present invention will hereinafter be described in greater detail with reference to the drawings.

Embodiment 1

Figure 1:
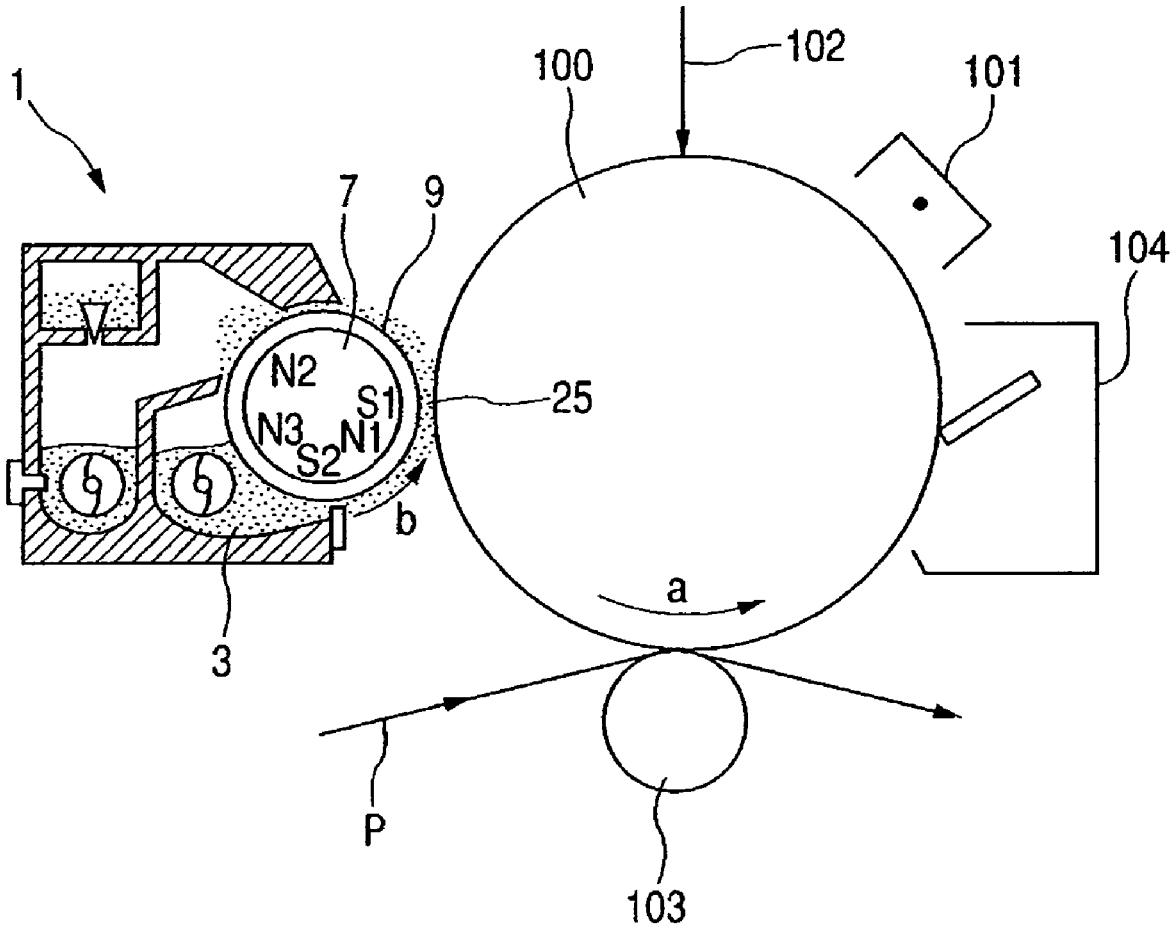
FIG. 1 schematically illustrates the construction of an embodiment of the image forming apparatus of the present invention.

FIG. 1 schematically shows the construction of an electrophotographic image forming apparatus which is an embodiment of the image forming apparatus of the present invention. In the present embodiment, the image forming apparatus is provided with a drum-shaped electrophotographic photosensitive member, i.e., a photosensitive drum 100, as an image bearing member. The photosensitive drum 100 is supported for rotation in the direction indicated by the arrow "a", and around the photosensitive drum 100, in the order of the rotation direction thereof, there are provided charging means 101, exposing means 102, a developing apparatus 1, transferring means 103 and cleaning means 104.

In the above-described construction, the photosensitive drum 100 is uniformly charged by the charging means 101, and then is image-exposed by the exposing means 102, whereby an electrostatic image is formed on the photosensitive drum 100. The electrostatic image on the photosensitive drum 100 is developed as a visible image, i.e., a toner image, by the developing apparatus 1. This toner image is transferred to a recording material P such as transfer paper by the transferring means 103. The recording material P to which the toner image has been transferred is conveyed to a fixing apparatus (not shown), where the toner image is fixed as a permanent image.

Any untransferred residual toner on the photosensitive drum 100 is removed by the cleaning means 104, and the photosensitive drum 100 is used for the next image formation.

Figure 2:
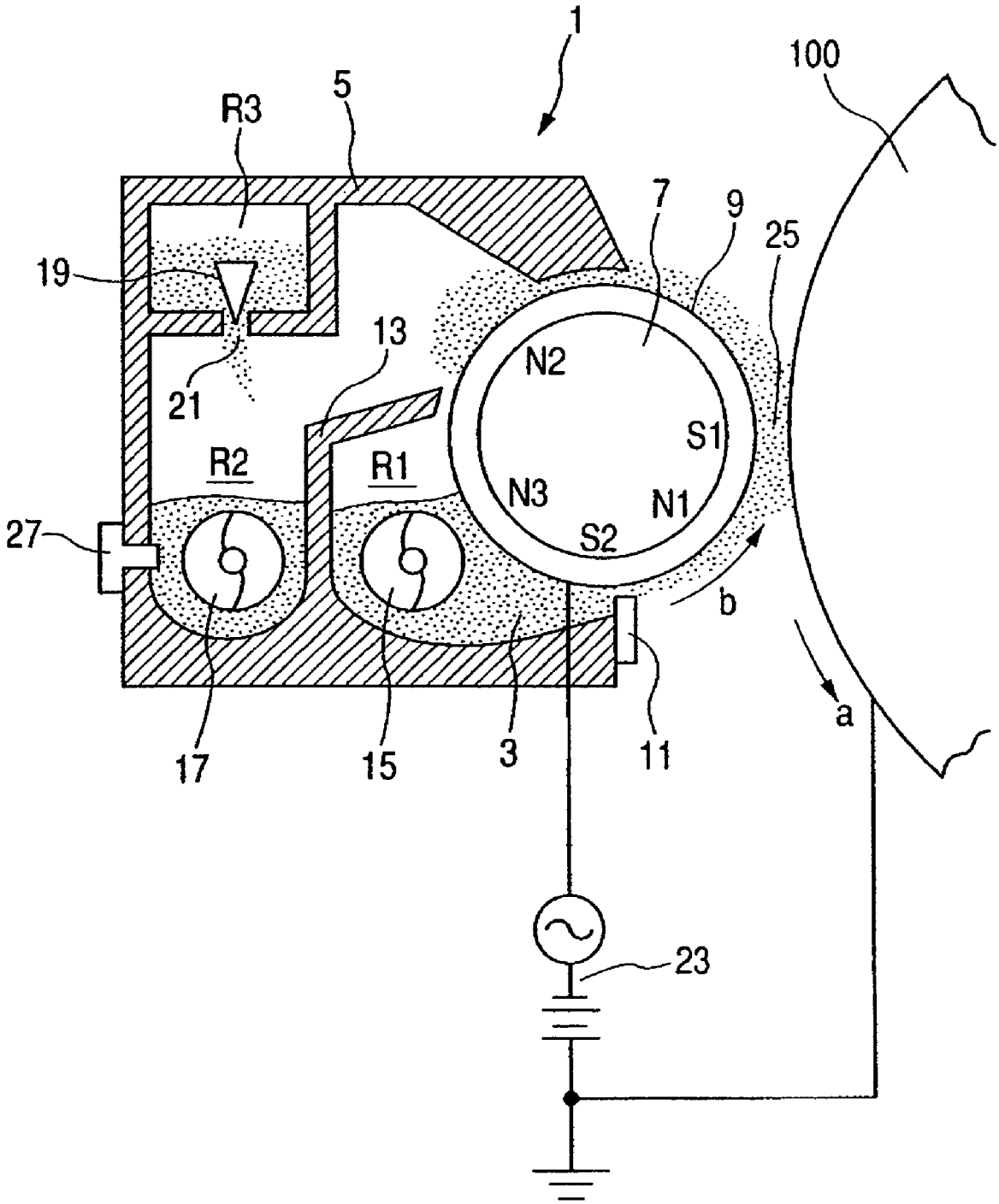
FIG. 2 is an enlarged view for illustrating the construction of a developing apparatus in FIG. 1.

FIG. 2 is an enlarged view showing the construction of the developing apparatus 1 and the vicinity of the photosensitive drum 100 in the image forming apparatus according to the present embodiment.

Referring to FIG. 2, the developing apparatus 1 is provided with a developer container 5 containing therein a two-component developer 3 comprising a nonmagnetic toner and a magnetic carrier mixed together, and a developing sleeve 9 as a developer carrying member is disposed in the opening portion of the developer container 5 which faces the photosensitive drum 100, in proximity to the photosensitive drum 100 with a predetermined gap therebetween.

The developing sleeve 9 comprises a cylinder of a nonmagnetic material such as aluminum or nonmagnetic stainless steel, and the surface thereof is provided with moderate unevenness. A magnet roller 7 as magnetic field generating means is fixedly disposed inside the developing sleeve 9. The magnet roller 7 has magnetic poles N1, S1, N2, N3 and S2. Also, a regulating blade 11 is disposed in proximity to the developing sleeve 9 with a predetermined gap therebetween.

Substantially the lower half of the interior of the developer container 5 is comparted into a developing chamber R1 and an agitating chamber R2 by a partition wall 13 protruding toward the developing sleeve 9, and developer carrying screws 15 and 17 are installed in respective ones of these chambers. A toner storing chamber R3 containing therein a toner 19 to be supplied is installed above the agitating chamber R2, and a supply port 21 is provided in the lower portion of the toner storing chamber R3.

The developer carrying screw 15 is rotated to thereby carry the developer in the developing chamber R1 along the longitudinal direction of the developing sleeve 9 while agitating it. The partition wall 13 is formed with openings (not shown) in this side and the inner part side thereof, as viewed in FIG. 2, and the developer carried to one side of the developing chamber R1 by the screw 15 is fed into the agitating chamber R2 through the opening in that one side of the partition wall 13, and is delivered to the developer carrying screw 17. The rotation direction of the screw 17 is opposite to that of the screw 15, and this screw 17 agitates and mixes the developer in the agitating chamber R2, the developer delivered from the developing chamber R1 and the toner supplied from the toner storing chamber R3 with one another and at the same time, carries these developers and the toner in the agitating chamber R2 in a direction opposite to the direction by the screw 15, and feeds them into the developing chamber R1 through the other opening in the partition wall 13.

To develop the electrostatic image formed on the photosensitive drum 100, by the developing apparatus 1 of the above-described construction, the developing sleeve 9 is first rotated in the direction indicated by the arrow "b", and the developer 3 in the developing chamber R1 is scooped onto and carried on the surface of the developing sleeve 9 by the magnetic poles N3 and S2 of the magnet roller 7. The developer carried on the developing sleeve 9 is carried to the regulating blade 11 with the rotation of the developing sleeve 9, and is regulated to a thin developer layer having a proper layer thickness thereby, and thereafter comes to a developing region 25 in which the developing sleeve 9 and the photosensitive drum 100 are opposed to each other in a non-contact state.

The magnetic pole (developing pole) S1 is located at that region of the magnet roller 7 which corresponds to the developing region 25, and the developing pole S1 forms a developing magnetic field in the developing region 25, and the developer is stood like the ears of rice by this developing magnetic field, whereby the magnetic brush of the developer is produced in the developing region 25. Then, the magnetic brush contacts with the photosensitive drum 100, and the toner adhering to the magnetic brush and the toner adhering to the surface of the developing sleeve 9 shift and adhere to the area of the electrostatic image on the photosensitive drum 100, and the latent image is developed and visualized as a toner image.

In case of this development, it is preferable to apply a developing bias comprising a DC voltage and an AC voltage superimposed one upon the other to between the developing sleeve 9 and the photosensitive drum 100 by a bias voltage source 23 to thereby promote development.

The developer having finished development is returned into the developer container 5 with the rotation of the developing sleeve 9, and is stripped off from the developing sleeve 9 by the repulsing magnetic field between the magnetic poles N2 and N3, and falls and is collected into the developing chamber R1 and the agitating chamber R2.

The nonmagnetic toner used in the image forming apparatus according to the present embodiment is a powder material having a predetermined range of particle diameter obtained by crushing and classifying a colorant dispersed in a binding resin, and the volume mean particle diameter thereof is 8 μm. The magnetic carrier is a ferrite core coated with silicon resin, and the volume mean particle diameter thereof is 45 μm.

Besides this, as the nonmagnetic toner, there is known one manufactured by a polymerizing method. Also, the volume particle diameter thereof is generally within a range of several μm to several tens of μm. Also, as the magnetic carrier, there are known various kinds comprising a magnetic material such as magnetite dispersed in a resin and used as a core.

The characteristic portion of the present invention will now be described with reference to FIGS. 3, 4A, 4B and 4C.

Figure 3:
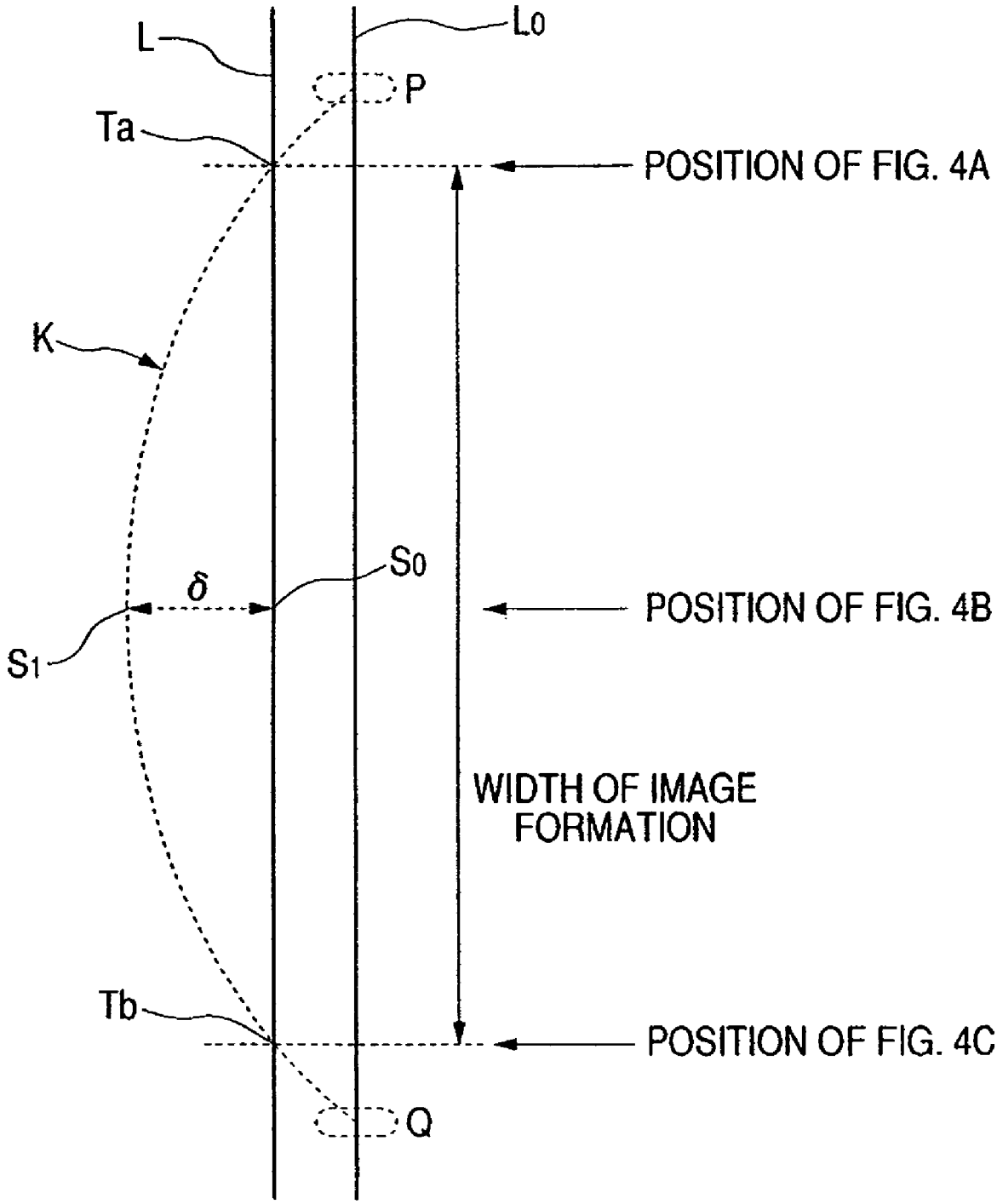
FIG. 3 illustrates the state of the deformation of a developing sleeve.

FIG. 3 shows a state in which the developing sleeve 9 in the present embodiment is flexed along the longitudinal axial direction thereof, i.e., the rotation axial direction thereof, when it carries the developer 3 thereon during the operation of actually performing the developing action, i.e., "during the actual operation".

In FIG. 3, for the convenience of illustration, the flexure direction is shown on an enlarged scale and therefore, differs from the actual dimensional relationship.

In the developing apparatus 1 before supplied with the developer 3, the rotation central shaft of the developing sleeve 9 in a state in which it does not carry the developer 3 thereon is supported in the developer container 5 by support members P and Q as rotation shaft receiving means disposed outside an image forming width formed along the rotation axial direction of the developing sleeve 9. When an axis passing through the support members P and Q is defined as $L_0$, the magnet roller 7 is also supported substantially on this axis. The image forming width referred to herein refers to the maximum forming width of the electrostatic image formed on the photosensitive drum 100 in the rotation axial direction of the photosensitive drum.

Here, the developer 3 is supplied into the developing apparatus 1, and the developing sleeve 9, the screw 15 and the screw 17 are rotatively driven. The developer 3 is circulated in the developer container 5, and reaches a steady state after a while. At this time, the developer 3 is stably carried on the surface of the developing sleeve 9.

The developer 3 carried on the surface of the developing sleeve 9 is attracted basically toward the magnetic poles of the magnet roller 7 by the magnetic attraction by the magnet roller 7. This direction is generally the direction of the rotation central axis of the developing sleeve 9. It is the developing sleeve 9 that carries thereon the developer 3 receiving this magnetic attraction and therefore, the developing sleeve 9 receives pressure from the developer 3 on the surface thereof. The pressure from the developer 3 is given from all of the developer 3 in the rotational circumferential direction of the developing sleeve 9 and therefore, the direction of the resultant force of the pressure applied to the developing sleeve 9 depends on the distribution of the adhering amount of the developer 3.

When the flexure of the developing sleeve 9 by the pressure of the developer 3 is shown in the longitudinal direction of the sleeve, the central axis of the developing sleeve 9 is flexed in the form of a bow like a curve K indicated by broken line in FIG. 3.

In FIG. 3, the image forming width is an area sandwiched by a point Ta and a point Tb in FIG. 3. The point Ta and the point Tb are points indicative of the centers of the circles of the developing sleeve 9 at the both ends of the image forming width, and a straight line passing through the point Ta and the point Tb is defined as L.

Now, the inventor measured the flexure amount of the developing sleeve 9 by this pressure by the aforedescribed method. The flexure amount δ (mm) used in the description of the present embodiment is the distance between the straight line L and the curve K at the central portion of the image forming width.

Figure 4A:
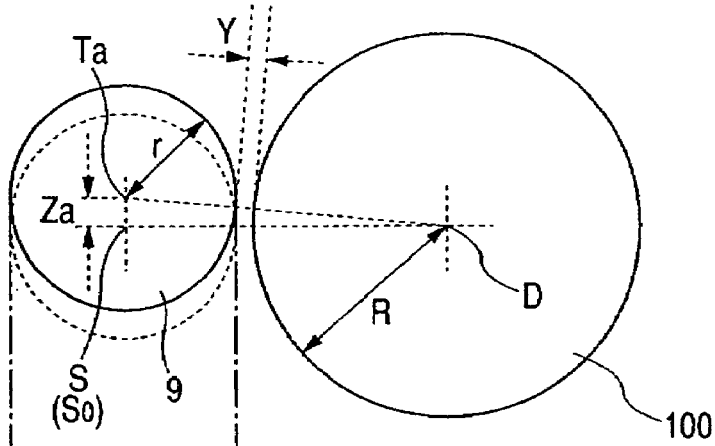
FIGS. 4A, 4B and 4C illustrate the relative disposition of the developing sleeve and a photosensitive drum.
Figure 4B:
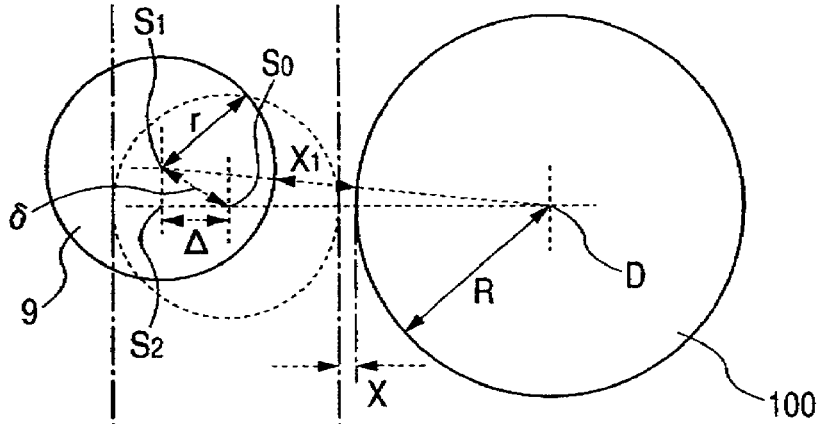
Figure 4C:
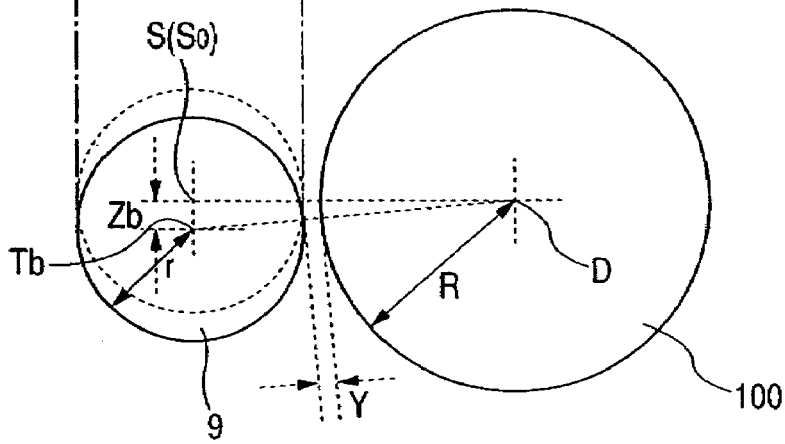

FIGS. 4A, 4B and 4C show the positional relationship between the developing sleeve 9 and the photosensitive drum 100 shown in FIG. 3 by the cross sections of the both ends and central portion of the image forming width, and are cross-sectional views in a direction perpendicular to the rotation central axis of the photosensitive drum 100.

The image forming apparatus according to the present embodiment can develop a toner image having a width (image forming width) of 310 mm in a direction perpendicular to the planes of the drawing sheets of FIGS. 1 and 2, and FIGS. 4A, 4B and 4C show the cross sections of the image forming apparatus on the innermost part side, the center, and this side, respectively, in the toner image forming width direction.

The toner image forming width is 310 mm and therefore, considering with FIG. 4B which is the central position as the reference, FIGS. 4A and 4C are cross-sectional views at positions of 155 mm toward the inner part side and this side, respectively, of the plane of the drawing sheet of FIGS. 4A, 4B and 4C.

For the convenience of illustration, FIGS. 4A, 4B and 4C show the flexure direction on an enlarged scale and therefore, differ from the actual dimensional relationship. Also, the heights of the axes of the developing sleeve 9 and the photosensitive drum 100 are substantially coincident with each other, but this is also for simplifying the illustration, and in the actual construction, such disposition is not restrictive.

In FIGS. 4A, 4B and 4C, the radius of the photosensitive drum 100 is defined as R (mm), the radius of the developing sleeve 9 is defined as r (mm), and the central axis of the photosensitive drum 100 is defined as D. The reference sign D originally indicates a straight line passing through the central axis, but is handled as a point on the straight line D in each cross-sectional view.

In FIGS. 4A and 4C, the point Ta and the point Tb are indicative of the central positions of the developing sleeve 9 in the respective cross sections.

Also, the points at which the cross section of FIG. 4B and the straight line L and the curve K intersect with one another are defined as a point $S_0$ and a point $S_1$, respectively. The flexure amount δ (mm), in FIG. 4B, is the length of a segment $S_0S_1$ linking the point $S_0$ and the point $S_1$ together. Also, a straight line passing through the point $S_0$ and parallel to the central axis D of the photosensitive drum 100 is defined as a straight line S.

Also, the foot (point of intersection) of a perpendicular from the point $S_1$ to a straight line $DS_0$ passing through the point D and the point $S_0$ is defined as a point $S_2$, and the length of a segment $S_0S_2$ linking the point $S_0$ and the point $S_2$ together is defined as Δ (mm).

Here, consideration is made of a case where the developing sleeve 9 is a cylinder tentatively having the straight line L as its central axis, that is, a case where in FIG. 4B, the central position of the developing sleeve 9 is at the point $S_0$. It is the distance X (mm) in FIG. 4B that corresponds to the SD distance at this time. The reference sign X is equal to the length of a segment $DS_0$ linking the point D and the point $S_0$ together, minus the sum of the radius R of the photosensitive drum 100 and the radius r of the developing sleeve 9.

$$X=(\text{the length of the segment } DS_0)-(R+r) \quad (3)$$

During the actual operation, the central position of the developing sleeve 9 is the point $S_1$ in FIG. 4B. When the actual SD distance at this time is defined as $X_1$ (mm), $$X_1=(\text{the length of the segment } DS_1)-(R+r) \quad (4)$$

Now, consider a triangle $S_1S_2D$ having the point $S_1$, the point $S_2$ and the point D as vertices. As is apparent from the definition of the point $S_2$, an angle $S_1S_2D$ having the point $S_2$ as its vertex is a right angle. Here, when an angle $S_1DS_2$ having the point D as its vertex is defined as θ, $$(\text{the length of the segment } DS_2)=(\text{the length of the segment } DS_1)\times\cos\theta \quad (5)$$

On the other hand, the length of the segment $DS_2$ is the sum of the length of the segment $DS_0$ and Δ and therefore, $$(\text{the length of the segment } DS_0)+\Delta=(\text{the length of the segment } DS_1)\times\cos\theta \quad (6)$$

From this expression and expressions (3) and (4), $$(X+\Delta+R+r)=(X_1+R+r)\times\cos\theta. \quad (7)$$

$X_1$ found from this expression is the SD distance during the actual operation in the central portion.

If here, accuracy is aimed at, the cosine theorem should be applied to a triangle $S_0S_1D$ to thereby calculate the value of cos.θ, and calculate Δ from the value of δ, but δ is a sufficiently small value as compared with R and r and therefore, the approximation that cosθ≈1 can be done.

From the foregoing, $$X_1=X+\Delta. \quad (8)$$

If here, the characteristic construction of the present invention as shown below is not adopted, but the rotation axes of the developing sleeve 9 and the photosensitive drum 100 are disposed in parallelism to each other, the SD distance at the both ends of the image forming width becomes X (mm). That is, if the SD distance at the both ends is adopted as the reference, the SD distance at the center is great at a rate of Δ/X. When this value is 1/10 or greater, it will often be the case that the uniformity of image density exceeds an allowable range.

Figure 5A:
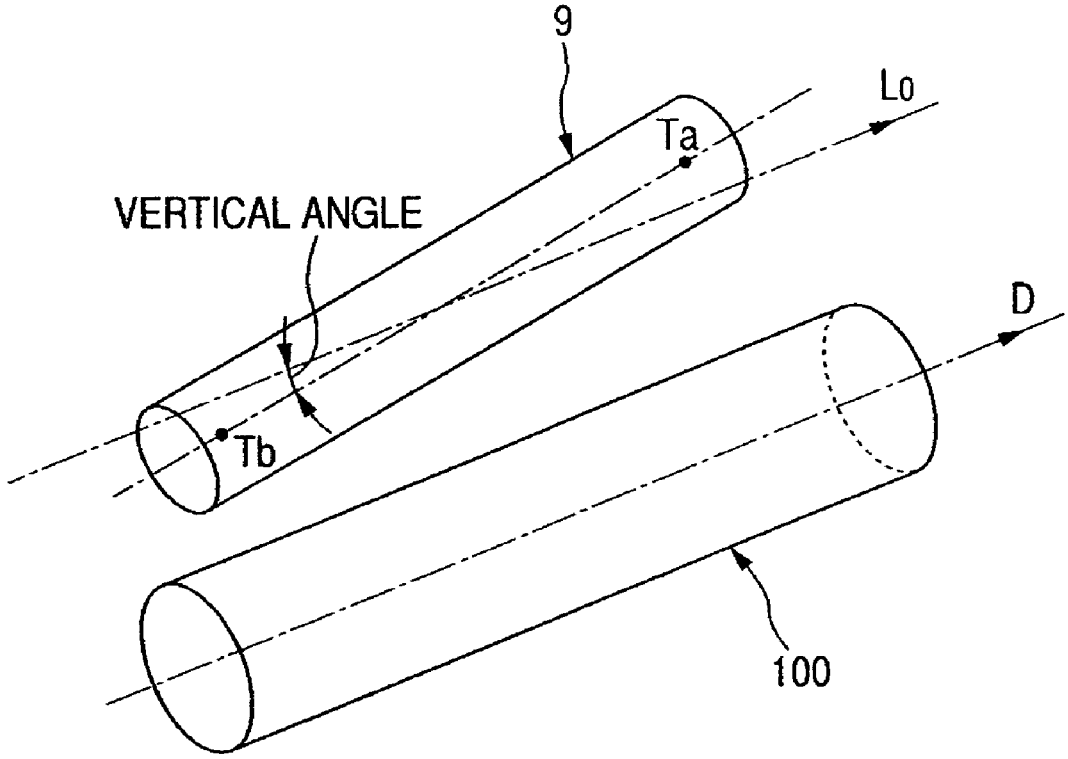
FIGS. 5A and 5B illustrate a vertical angle.
Figure 5B:
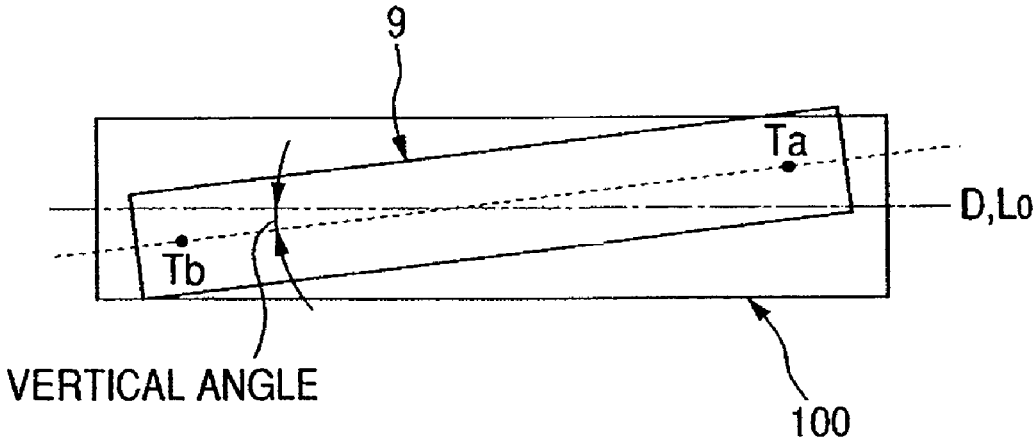
Figure 6:
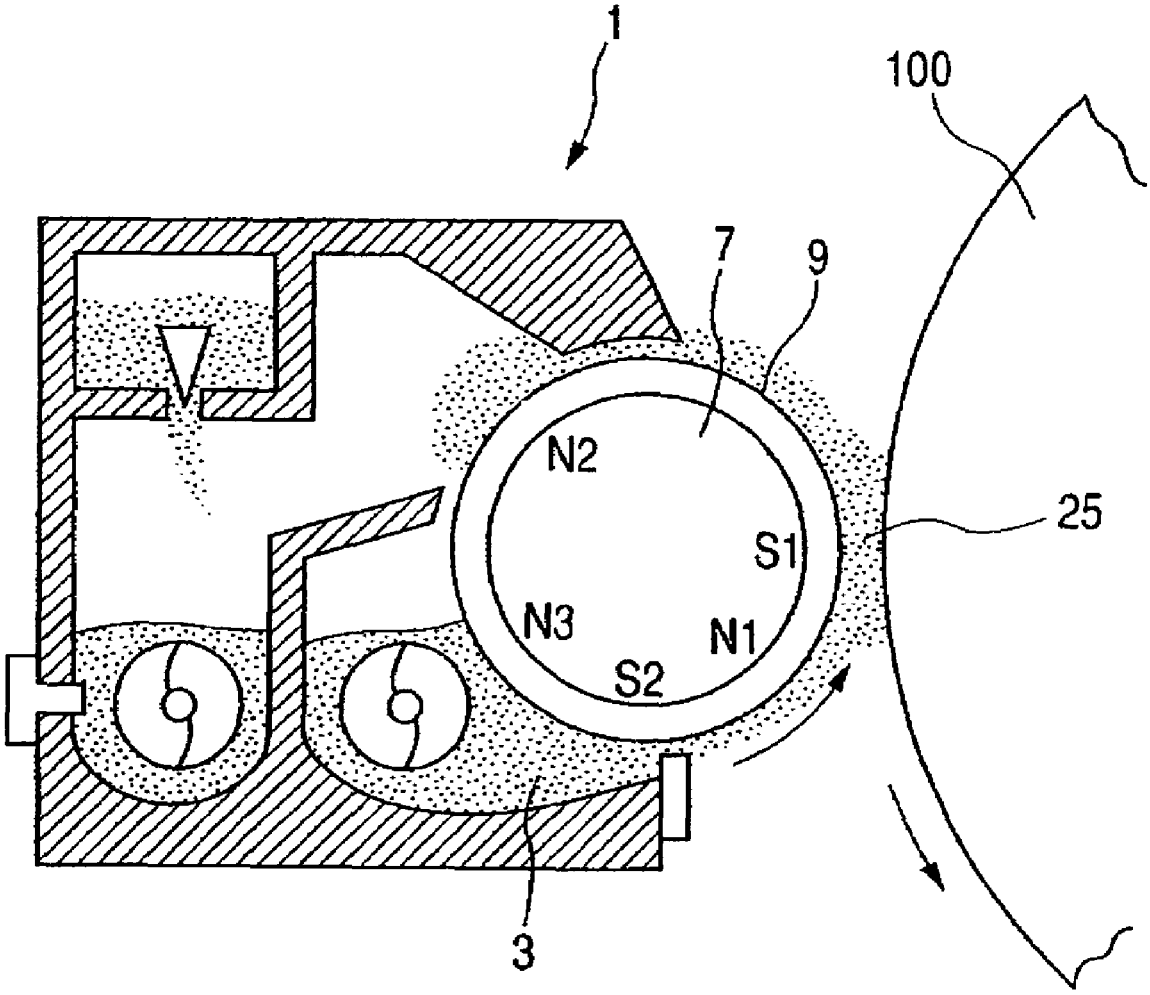
FIG. 6 schematically illustrates the construction of a conventional image forming apparatus.

So, the construction forming the feature of the present invention resides in that in such a case where Δ/X becomes 1/10 or greater, as shown in FIGS. 4A and 4C, a vertical angle is provided between the straight line L linking the point Ta and the point Tb together and the central axis of the photosensitive drum 100 (that is, the straight line L and the rotation axis of the drum are brought into a skew relationship), whereby the SD distances at the both ends and at the center are made equal to each other to thereby improve the uniformity of image density. Here, the vertical angle, as shown also in FIGS. 5A and 5B, refers to an angle formed by a straight line TaTb with respect to the central axis D (or a straight line $L_0$ parallel to the axis D) of the photosensitive drum 100.

That is, according to the present invention, as described above, the axial direction of the photosensitive drum and the axial direction of the developing sleeve 9 are disposed so as to have a vertical angle so that even if the developing sleeve 9 opposed to the photosensitive drum 100 is flexed in a direction in which the surface of the developing sleeve 9 goes away from the surface of the photosensitive drum 100, by an extraneous force applied in an actual operative state, the distance between the photosensitive drum 100 and the developing sleeve 9 in the actual operative state may be substantially equal at the both end portions and the central portions of the image forming width in the direction of the rotation axis, whereby the amount of flexure of the developing sleeve 9 can be negated by a disposition having the vertical angle attached thereto, and in the actual operative state, the distance between the photosensitive drum 100 and the developing sleeve 9 becomes constant in the axial direction thereof.

By this effect, it becomes possible to provide an image forming apparatus which can form an image of high quality improved in the uniformity of image density while keeping a lower cost even when the developing sleeve is made small in diameter to meet the requirement for the downsizing of the image forming apparatus which is the object of the present invention.

Further describing, when the point $S_0$ is projected in a direction parallel to the rotation axis D in the respective cross sections of FIGS. 4A and 4C, the points Ta and Tb are disposed so that a segment $DS_0$ and segments $TaS_0$ and $TbS_0$ may be substantially orthogonal to each other at the point $S_0$, and the distance between the point Ta and the straight line S (point $S_0$) is defined as Za (mm), and the distance between the point Tb and the straight line S (point $S_0$) is defined as Zb (mm).

In FIG. 4A, a triangle linking the points $S_0$, Ta and D together is a right-angled triangle having a right angle at the vertex $S_0$ and therefore, there is the following relation among the lengths of the respective sides thereof:

$$(\text{segment } S_0Ta)^2+(\text{segment } S_0D)^2=(\text{segment } TaD)^2 \quad (9)$$

Here, when the SD distance in the cross section of FIG. 4A is defined as Y, Y is the length of the segment TaD minus (R+r) and therefore, $$Y=(\text{the length of the segment } TaD)-(R+r) \quad (10)$$

that is, from numerical expressions (4) and (5), $$Za^2+(R+r+X)^2=(R+r+Y)^2 \quad .(11)$$

Consequently, conforming to the object of the present invention (to make the difference between the SD distances at the center and the end portions smaller than the flexure amount of the developing sleeve), design can be made such that $$\Delta>X_1-Y \quad .(12)$$

The flexure amount referred to here is Δ (the length of a segment linking the point $S_2$ and the point $S_0$ together) in FIG. 4B. That is, this is a component which affects the SD distance at the maximum flexure amount δ of the sleeve.

Here, from numerical expression (8), $X_1=X+\Delta$ and therefore, the condition of numerical expression (12) becomes Y>X, and from this and numerical expression (11), it follows that if any other value than 0 is selected as Za, the condition of numerical expression (12) is achieved. That is, by "disposing the relation between the developing sleeve and the photosensitive drum in the skew relationship", it is achieved "to make the difference between the SD distances at the center and the end portions smaller than the flexure amount of the developing sleeve" which is the object of the present invention.

Next, the relation like that of the above-mentioned numerical expression (12) is satisfied and moreover, the optimum positional relationship in the skew relationship between the developing sleeve and the photosensitive drum becomes as follows.

First, ideally, it will suffice if the SD distances at the end portions and the center become equal to each other. That is, it will suffice if design is made such that Y becomes equal to $X_1$(=X+Δ) and therefore, $$Za^2+(R+r+X)^2=(R+r+X+\Delta)^2 \quad .(13)$$

That is, the design center value of Za can be expressed as follows.

$$Za=\{(R+r+X+\Delta)^2-(R+r+X)^2\}^{1/2} \quad (14)$$

When a similar calculation is also effected regarding the point Zb in FIG. 4C, $$Zb=\{(R+r+X+\Delta)^2-(R+r+X)^2\}^{1/2} \quad .(15)$$

Now, according to the above-mentioned numerical expressions (14) and (15), the SD distances at the both end portions and the center in the present embodiment become equal to each other, but actually, even if strictly this numerical value is not adopted, the uniformity of image density can be kept.

According to the inventor's experience, if the amount of fluctuation in the SD distances at the both end portions and the center is suppressed to 1/20, that is, if the axis of the photosensitive drum 100 and the axis of the developing sleeve 9 are disposed so as to be in the direction of skew so that in the actual operative state, the distance between the photosensitive drum 100 and the developing sleeve 9 at the both end portions of the image forming width in the rotation axial direction may be with a range of 95% to 105% relative to the distance between the photosensitive drum 100 and the developing sleeve 9 at the central portions of the image forming width in the rotation axial direction, a satisfactory result can be obtained as the uniformity of image density even under a condition under which the above-mentioned fluctuation is easy to pick up.

That is, on the assumption that $\alpha$=X/20 (mm), Za (mm) and Zb (mm) are designed to be within the following ranges, whereby the object of the present invention is achieved.

$$\{(R+r+X+\Delta-\alpha)^2-(R+r+X)^2\}^{1/2} \leqq Za \leqq \{(R+r+X+\Delta+\alpha)^2-(R+r+X)^2\}^{1/2} \quad \text{expression (1)}$$

$$\{(R+r+X+\Delta-\alpha)^2-(R+r+X)^2\}^{1/2} \leqq Zb \leqq \{(R+r+X+\Delta+\alpha)^2-(R+r+X)^2\}^{1/2} \quad \text{expression (1)}$$

That is, according to the present invention, as described above, even in the case of such a construction in which the SD distance differs by 10% or greater between the both end positions and the central position of the image forming width, the photosensitive drum and the developing sleeve are disposed with a vertical angle so as to satisfy numerical expressions (1) and (2), whereby the fluctuation of the SD distance can be kept equal to or less than 5% in the axial direction. Accordingly, the object of the present invention can be achieved more preferably.

Regarding numerical expressions (1) and (2) presented in the present embodiment, the result of the calculation of specific numerical values is as follows.

TABLE 1

| | | | | | |
|---|---|---|---|---|---|
| R (mm) | 10 | 10 | 15 | 30 | 90 |
| r (mm) | 4 | 4 | 8 | 12 | 20 |
| X (mm) | 0.200 | 0.200 | 0.400 | 0.500 | 1.000 |
| Δ (mm) | 0.020 | 0.200 | 0.060 | 0.040 | 0.200 |
| α (mm) | 0.010 | 0.010 | 0.020 | 0.025 | 0.050 |
| Zmax (mm) | 0.924 | 2.451 | 1.937 | 2.351 | 7.454 |
| Zstd (mm) | 0.754 | 2.392 | 1.677 | 1.844 | 6.666 |
| Zmin (mm) | 0.533 | 2.331 | 1.369 | 1.129 | 5.773 |
| Zmax-Zmin (mm) | 0.391 | 0.120 | 0.568 | 1.222 | 1.681 |

In Table 1, values indicated as Z are numerical values corresponding to Za and Zb, and Zmax are values corresponding to the right sides of numerical expressions (1) and (2), and Zmin are values corresponding to the left sides of numerical expressions (1) and (2). Also, Zstd shows the target values of Za and Zb shown in numerical expressions (14) and (15). Zmax−Zmin at the lowermost stage are values indicative of the range of the positional tolerance when Zstd is defined as the center design value, and numerical values which can be sufficiently designed in reality.

Here, what need be noted is the opposed position of the photosensitive drum 100 to the flexure direction of the developing sleeve 9.

In the foregoing, description has been made with respect to such a system that the developing sleeve 9 is flexed to thereby go away from the surface of the photosensitive drum 100, but in a converse case, the method of providing the vertical angle as in the present embodiment cannot improve the non-uniformity of the SD distance. This can also be seen from the fact that when in numerical expressions (1), (2), (14) and (15), Δ is a negative numerical value, a term which becomes an imaginary number occurs.

That is, as a condition for realizing the present invention, it is necessary to dispose the photosensitive drum 100 and the developing sleeve 9 so that the angle formed by and between a direction in which the developing sleeve 9 is flexed by an extraneous force applied thereto in the actual operative state and the direction of the central position of the photosensitive drum 100 as viewed from the central position of the developing sleeve 9 may be an obtuse angle.

Also, describing about the application range of Δ, the lower limit thereof is X/10 which is a range in which the present invention is required to be, and of course, X is a positive number. Also, as regards the upper limit value of Δ, there is not an upper limit to Δ when considered only in the disposition relationship, but regarding δ (it is apparent that Δ≦δ) which is the magnitude of the actual flexure, there is a possibility such as fracture due to the permanent deformation or endurance of the developing sleeve 9 and therefore, it is considered that 0.20 mm or less is preferable.

Further, adding about the uniformity of the SD distance in the direction of the image forming width, in the present embodiment, it has been described that by the SD distances at the both end portions and the central portion being made coincident with each other, the SD distance becomes uniform.

If greater accuracy is aimed at, the flexure of the developing sleeve 9 originally ought to assume a shape approximate to a parabola in calculation, and the correction curve by the vertical angle assumes a shape approximate to an elliptical arc and therefore, it is necessary to discuss the difference in shape between a parabolic shape and an elliptical arc, but in view of the object of the present invention, it can be considered to be an error range and therefore, description has been restricted to the foregoing description.

Adding about the magnetic poles of the magnet roller 7, in a magnet roller 7 usually used, the magnetic poles thereof are formed in parallelism to the rotation axial direction of the developing sleeve 9. From the viewpoint of image density, it seems that a change in the positions of the magnetic poles by the construction of the present embodiment is small in influence, but considering the securement of the latitude of a microscopic quality of image such as the coarseness of a medium density portion, it is preferable to dispose the magnetic poles so as to provide a vertical angle to the rotation axial direction of the developing sleeve 9, and so as to be parallel to the rotation axial direction of the photosensitive drum.

That is, as described above, the plurality of magnetic poles provided on the magnet roller 7 include a developing pole opposed to the photosensitive drum 100 for effecting the development of the electrostatic image, and if this developing pole is disposed substantially in parallel to the photosensitive drum 100, and is disposed with a vertical angle to the rotation axial direction of the developing sleeve 9, the relative position of the developing magnetic pole in the developing region can be made constant in the axial direction, and the effect of the securement of the latitude to a microscopic quality of image such as the coarseness of the medium density portion can be additionally obtained.

Further adding, as a parameter as important as the SD distance in stabilizing image density, there is the layer thickness of the developer 3 on the developing sleeve 9, and this layer thickness depends on the gap (SB gap) between the developing sleeve 9 and the regulating blade 11. That is, in the uniformization of image density in the rotation axial direction, the influence of the flexure of the developing sleeve 9 depends not only on the SD distance, but also on the SB gap.

The fluctuation of the SB gap before and after the coating with the developer 3 corresponds to the direction component of the aforedescribed δ (mm) traveling from the developing sleeve 9 to the regulating blade 11.

In the present embodiment, design is made such that the opposed portion of the regulating blade 11 to the developing sleeve 9 is formed so as to have a curve on a parabola, and the layer thickness of the developer 3 during the actual driving becomes uniform in the rotation axial direction.

Such a method of modifying the non-uniformity of the layer thickness attributable to the flexure of the developing sleeve 9 by the shape of the regulating blade 11 need not be combined with a construction in which the rotation axes of the developing sleeve 9 and the photosensitive drum 100 as in the present invention are given a vertical angle, but can obtain a single effect only by itself.

While in the above-described embodiment, the image bearing member and the developer carrying member have been described as a photosensitive drum and a developing sleeve of a cylindrical shape each having a predetermined radius, they are not restricted to such shape, but it is also possible to construct at least one member so as to form a portion of a cylinder in the opposed portion forming the developing region so that for example, at least one of the image bearing member and the developer carrying member may be made into a belt shape.

This application claims priority from Japanese Patent Application No. 2005-029875 filed Feb. 4, 2005, which is hereby incorporated by reference herein.

What is claimed is:

1. An image forming apparatus comprising:

an image bearing member bearing an electrostatic image thereon; said image bearing member having a circular arc configuration in a developing region;

a developer carrying member carrying thereon a developer and carrying the developer to said developing region for developing said electrostatic image, said developer carrying member being rotatably supported and disposed at developer carrying member supporting positions in areas outside of an area opposed to a maximum electrostatic image forming width in a rotation axial direction of said image bearing member so as to be in non-contact with said image bearing member in said developing region, and said developer carrying member being designed to be flexed by a force acting in an operative state so that in an area inside said developer carrying member supporting positions, the surface of said developer carrying member may go away from the surface of said image bearing member, wherein said image bearing member and said developer carrying member are disposed so that a rotation axis of said image bearing member and a straight line passing through centers of cross-sectional shapes of said developer carrying member in a direction perpendicular to the rotation axial direction of said developer carrying member at both end portions of the area opposed to the maximum electrostatic image forming width may be in a skew relationship so that in said operative state, a value of a difference between a closest distance between said image bearing member and said developer carrying member at a central portion of said maximum electrostatic image forming width and a closest distance between said image bearing member and said developer carrying member at said both end portions thereof may become smaller than a value of a component of a flexure amount of said developer carrying member in the area opposed to said maximum electrostatic image forming width, in a direction of said closest distance.

2. An image forming apparatus according to claim 1, wherein the closest distance between said image bearing member and said developer carrying member at said both end portions is within a range of 95% to 105% relative to the closest distance between said image bearing member and said developer carrying member at said central portion.

3. An image forming apparatus according to claim 2, wherein when in an opposed portion of said image bearing member and said developer carrying member forming said developing region, a radius of curvature of said image bearing member is defined as R (mm) and a radius of curvature of said developer carrying member is defined as r (mm), a rotation central axis of said image bearing member is defined as a straight line D, central points of circles of the radius r (mm) of curvature described by said developer carrying member in respective cross sections of said both end portions of said developer carrying member when said developer is carried on said developer carrying member to thereby bring about said operative state are defined as Ta and Tb, a straight line linking said points Ta and Tb together is defined as L, a point on said straight line L which corresponds to a central portion of the area opposed to said electrostatic image forming width in the rotation axial direction is defined as $S_0$, a straight line passing through said point $S_0$ and parallel to said straight line D is defined as a straight line S, in a cross section at said central portion, a point of intersection between said cross section and said straight line D is defined as a point D, a central point of a circle of a radius r (mm) described by said developer carrying member in said actual operative state is defined as $S_1$, a length of a segment $S_0S_1$ linking said point $S_0$ and said point $S_1$ together is defined as δ (mm), a point of intersection between a straight line $DS_0$ passing through said point D and said point $S_0$ and a perpendicular from said point $S_1$ is defined as $S_2$, a length of a segment $S_0S_2$ linking said point $S_0$ and said point $S_2$ together is defined as Δ (mm), and X (mm)=a length of the segment $DS_0$ linking said point D and said point $S_0$ together—(R+r) (mm), $\delta$ (mm)$\leqq$0.20 (mm)

$\Delta$ (mm)$\geqq$X/10 (mm)

and when viewed from the rotation axial direction of said image bearing member, said points Ta and Tb are disposed so that said segment $DS_0$ and a segment TaTb may be substantially orthogonal to each other at said point $S_0$, and when a distance between said point Ta and said straight line S is defined as Za (mm) and a distance between said point Tb and said straight line S is defined as Zb (mm), and $\alpha$=X/20 (mm), the following expressions (1) and (2) are satisfied:

$$\{(R+r+X+\Delta-\alpha)^2-(R+r+X)^2\}^{1/2} \leqq Za \leqq \{(R+r+X+\Delta+\alpha)^2-(R+r+X)^2\}^{1/2} \quad \text{expression (1)}$$

$$\{(R+r+X+\Delta-\alpha)^2-(R+r+X)^2\}^{1/2} \leqq Zb \leqq \{(R+r+X+\Delta+\alpha)^2-(R+r+X)^2\}^{1/2} \quad \text{expression (2).}$$

4. An image forming apparatus according to claim 1, wherein the developer includes at least a magnetic material, and said developer carrying member is a hollow tube, and is provided therein with magnetic field generating means having a plurality of magnetic poles disposed along a rotation direction of said developer carrying member.

5. An image forming apparatus according to claim 1, wherein a layer thickness regulating member for regulating a layer thickness of the developer on said developer carrying member is provided so as to be opposed to the surface of said developer carrying member.

6. An image forming apparatus according to claim 4, wherein the plurality of magnetic poles provided on said magnetic field generating means include a pair of repulsing poles comprising a pair of magnetic poles of the same polarity adjacent to each other in the rotation direction of said developer carrying member.

7. An image forming apparatus according to claim 4, wherein the plurality of magnetic poles provided on said magnetic field generating means include a developing pole opposed to said image bearing member for effecting a development of the electrostatic image, and said developing pole is disposed substantially in parallel to said image bearing member.

* * * * *

UNITED STATES PATENT AND TRADEMARK OFFICE

CERTIFICATE OF CORRECTION

PATENT NO. : 7,362,991 B2
APPLICATION NO. : 11/335598
DATED : April 22, 2008
INVENTOR(S) : Shigeru Tanaka It is certified that error appears in the above-identified patent and that said Letters Patent is hereby corrected as shown below:

COLUMN 2:

Line 18, "developer" should read --developer is--.
Line 31, "9" should read --9)--.

COLUMN 4:

Line 21, "thereon;" should read --thereon,--.

COLUMN 9:

Line 26, "cos.θ," should read --cosθ,--.

COLUMN 15:

Lines 15 through 21,

"

$$\left\{(R+r+X+\Delta-\alpha)^2-(R+r+X)^2\right\}^{1/2} \leq Za \leq \left\{(R+r+X+\Delta+\alpha)^2-(R+r+X)^2\right\}^{1/2} \quad \text{expression (1)}$$

$$\left\{(R+r+X+\Delta-\alpha)^2-(R+r+X)^2\right\}^{1/2} \leq Za \leq \left\{(R+r+X+\Delta+\alpha)^2-(R+r+X)^2\right\}^{1/2} \quad \text{expression (2).}$$

"

should read

--

$$\left\{(R+r+X+\Delta-\alpha)^2-(R+r+X)^2\right\}^{1/2} \leq Za \leq \left\{(R+r+X+\Delta+\alpha)^2-(R+r+X)^2\right\}^{1/2} \quad \text{expression (1)}$$

$$\left\{(R+r+X+\Delta-\alpha)^2-(R+r+X)^2\right\}^{1/2} \leq Za \leq \left\{(R+r+X+\Delta+\alpha)^2-(R+r+X)^2\right\}^{1/2} \quad \text{expression (2).}$$

--.

UNITED STATES PATENT AND TRADEMARK OFFICE

CERTIFICATE OF CORRECTION

PATENT NO. : 7,362,991 B2
APPLICATION NO. : 11/335598
DATED : April 22, 2008
INVENTOR(S) : Shigeru Tanaka It is certified that error appears in the above-identified patent and that said Letters Patent is hereby corrected as shown below:

COLUMN 16:

Line 11, "include" should read --includes--.
Line 17, "include" should read --includes--.

Signed and Sealed this

Twenty-first Day of October, 2008

JON W. DUDAS
*Director of the United States Patent and Trademark Office*